United States Patent [19]

Hyduck

[11] Patent Number: 4,711,150

[45] Date of Patent: Dec. 8, 1987

[54] PICK FOR STRINGED INSTRUMENTS

[76] Inventor: Steven J. Hyduck, 17 Saltaire Dr., Saybrook, Conn. 06475

[21] Appl. No.: 677,989

[22] Filed: Dec. 4, 1984

[51] Int. Cl.[4] ..... G10D 3/16

[52] U.S. Cl. ..... 84/322

[58] Field of Search ..... 84/322

[56] References Cited

U.S. PATENT DOCUMENTS

| | | | |
|---|---|---|---|
| D. 132,717 | 6/1942 | Galetzky . | |
| 557,293 | 3/1896 | Wahl . | |
| 584,653 | 6/1897 | Sivils . | |
| 768,241 | 8/1904 | Seidel . | |
| 1,009,403 | 11/1911 | Gaynor . | |
| 1,184,561 | 5/1916 | Napoletano . | |
| 1,263,740 | 4/1918 | Burdwise . | |
| 1,461,070 | 7/1923 | Rudesyle . | |
| 2,016,438 | 10/1935 | Kealoha | 84/322 |
| 2,449,890 | 9/1948 | Garlick | 84/322 |
| 2,459,274 | 1/1949 | Galetzky | 84/322 X |
| 2,961,912 | 11/1960 | Meola | 84/322 |
| 3,112,668 | 12/1963 | Moshay | 84/322 |
| 3,319,505 | 5/1967 | Galetzky | 84/322 |
| 4,020,732 | 5/1977 | Kelly | 84/322 |
| 4,137,814 | 2/1979 | Rowley | 84/322 |
| 4,253,372 | 3/1981 | Filipetti | 84/322 |
| 4,347,773 | 9/1982 | Zook | 84/322 |

FOREIGN PATENT DOCUMENTS

| | | | |
|---|---|---|---|
| 2533344 | 3/1984 | France | 84/322 |
| 194966 | 3/1923 | United Kingdom . | |
| 333779 | 8/1930 | United Kingdom . | |

*Primary Examiner*—Lawrence R. Franklin

*Attorney, Agent, or Firm*—Costas, Montgomery & Dorman

[57] ABSTRACT

A pick for a stringed instrument having a finger gripping portion and a picking portion where the thumb side gripping is formed with a generally rectangular recess and the forefinger gripping side is a generally rectangular slot having a nominal center line forming a substantial transverse angle with the length of the thumb gripping portion.

10 Claims, 8 Drawing Figures

PICK FOR STRINGED INSTRUMENTS

FIELD OF THE INVENTION

This invention relates to musicians' picks for stringed instruments.

BACKGROUND OF THE INVENTION

Picks for stringed instruments such as guitars, mandolins, and various other stringed instruments, have been known and utilized for many years. Such picks are generally of an overall triangular or teardrop shape, having parallel opposed surfaces Such picks must be firmly grasped between the thumb and a finger of the musician, usually the forefinger; otherwise, there will be a tendency for the pick to slip in the fingers of the musician.

The prior art has long recognized this slippage problem and suggested that the finger portion of the pick have indentations to receive the thumb and/or a finger of a player in the gripping portion of a pick to prevent slippage in the fingers of a player. Such prior art is exemplified in U.S. Pat. Nos. 557,293; 1,009,403; 1,184,561; 1,263,740; 1,461,070; and 3,112,668.

However, this prior art has not taken into consideration the basic manner in which a musician's pick is held by the musician. Additionally, such prior art has not taken into consideration the basic manner in which a string of a stringed instrument is stroked to create vibration and ultimately, a note therefrom. When a musician, such as a guitarist, strokes a string, the pick should rapidly come off the string so that the musician may be in a position to stroke another string or the same string for the next note. In the picks presently used the picking portion must be pushed through a string until the pick snaps off the string. This limits the time that a musician has for transferring from one note to the next.

Accordingly, the present invention provides a new and improved pick for stringed instruments, which includes a new and improved gripping portion for the fingers of a musician, and further provides a picking portion which will slide off a string to permit rapid vibration thereof without taking the time required to have the pick stroked through the string.

SUMMARY OF THE INVENTION

Briefly stated, the invention in one form thereof comprises a pick for a stringed instrument which comprises new and distinct finger holding and picking portions.

The finger holding portion on the thumb side comprises a thumb depression of generally rectangular shape defined by rims on three sides thereof, and the picking portion on the other side thereof, and a depression on the forefinger side thereof, which is longitudinally at a substantial angle to the thumb depression. The depressions are contoured for optimum gripping by the thumb and forefinger of a musician. Additionally, a rim about the thumb depression is substantially perpendicular to the length of the thumb to further insure positive gripping of the finger portion of the pick. The forefinger depression preferably has a run-out at the end opposite the picking end of the pick to enhance gripping.

The picking portion of the pick is preferably defined by tapered surfaces to increase the ability of the pick to rapidly move off of a picked string to prepare the musician for picking of the next note.

A pick embodying the invention further has preferable geometry which is hereinafter described.

An object of this invention is to provide a new and improved musicians' pick which provides more positive gripping thereof to the musician.

Another object of this invention is to provide a new and improved musicians' pick which will rapidly leave a picked string and enable a musician to more rapidly contact a string for the next note.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENTS OF THE INVENTION

A pick 10 embodying the invention comprises a picking portion 11 and a finger grasp or grip portion 12.

Figure 1:
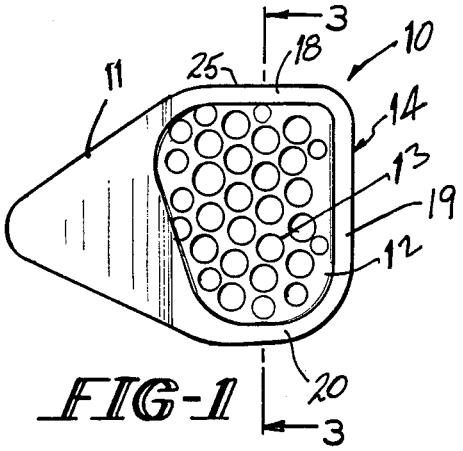
FIG. 1 is a plan view of a pick embodying the invention showing the thumb gripping side up.
Figure 3:
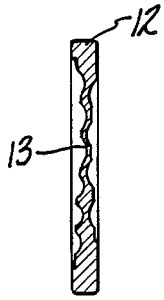
FIG. 3 is a view seen in the plane of lines 3—3 of FIG. 1.

Pick portion 11 is generally triangular in shape and is tapered in cross section as hereinafter explained. As shown in FIG. 1, a recess 13 is defined in finger grips portion 12 for the thumb and is textured to help achieve a firm grip.

The thumb gripping portion 12 is depressed and defined on three sides by a rim generally designated as 14 which is of generally rectangular and preferably trapezoidal shape. This is conducive to the grasping position of the shape of the thumb (FIG. 8) as hereinafter described.

Figure 8:
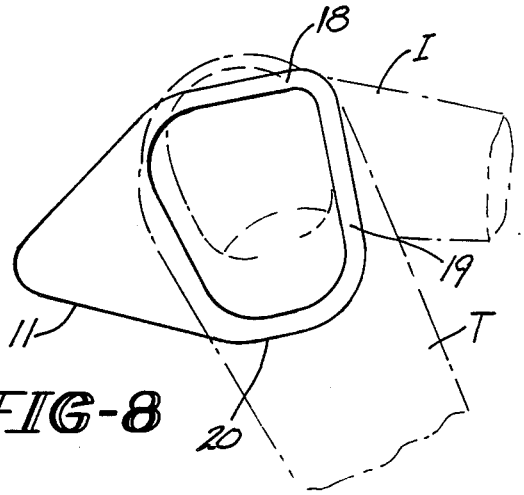
FIG. 8 is a view of the pick embodying the invention showing engagement thereof by the thumb and forefingers of a musician.
Figure 4:
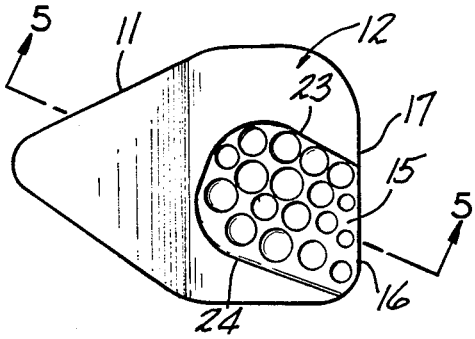
FIG. 4 is a bottom plan view of the pick of FIG. 1.

FIG. 4 exemplifies the opposite side of the pick 10, and shows the recessed grasping portion 15 for the forefinger I (FIG. 8). The recessed area for the forefinger has a run-out 16 at the end 17 of the forefinger grasping portion 15. The forefinger grasping portion 15 and the thumb grasping portion 12 extend generally transverse to each other, as hereinafter explained in accordance with the natural finger and thumb positions of the musicians and the optimum grasping positions. The forefinger grasping depression is also textured as shown. Both gripping portions 12 and 15 are substantially linearly extending in the direction of the gripping finger.

The texturing of the finger and thumb portions is for the purpose of enhancing the grip or grasp on the finger portion, but may be omitted.

As shown in FIGS. 1 and 8, the thumb gripping portion 12 is of generally trapezoidal shape and includes defined rims 18, 19, and 20, defining the thumb grip or grasp 12.

The finger portion 12 of the pick 10 is configured so that a portion of the thumb T overlies rim 18. This provides more positive grip on the finger portion by the thumb. Also, the run-out 16 on the forefinger gripping side of the pick provides more positive gripping. The thumb T contacts all of the rims 18, 19, and 20, and also the textured gripping portion 13.

Figure 2:
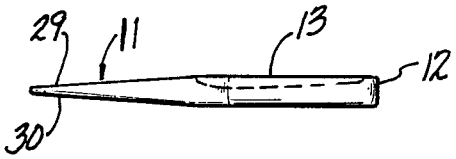
FIG. 2 is a side view of the pick of FIG. 1.
Figure 5:
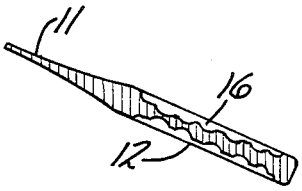
FIG. 5 is a view seen in the plane of lines 5—5 of FIG. 4.

It is of particular importance that the thumb contact rim 18. This provides a more positive grip on the finger portion of the pick. It will be noted that the recess 13 is configured or curved to conform to the contacting shape of the thumb along the length thereof, as shown in FIGS. 2 and 5. The portion of recess 13 is deeper adjacent rim 18. The recess 16 is also curved along its length to conform to the shape of the end of the forefinger I, as shown in FIG. 5. The recess 13 is deeper toward the picking end.

For best gripping action, the angle A between rim 19 and edge 22 of recess 13 should be approximately twenty degrees. The edges 23 and 24 defining recess 16 for the forefinger should be at angles B and C of approximately twenty and thirty degrees, respectively, with respect to edge 25 of the pick.

Figure 6:
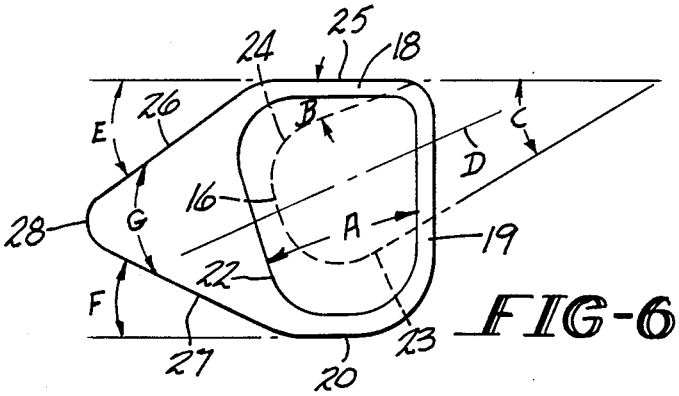
FIG. 6 is a top plan view from the thumb engaging side of a pick embodying the invention similar to FIG. 1, set forth for purposes of showing geometric relationships.

Generally speaking, the nominal center line of recess 16 as exemplified by line D in FIG. 6, should from an angle of fifty-five to eighty degrees with the edge of rim 19. An angle of about sixty-five degrees is preferred.

The picking portion 11 is generally triangular in shape, tapering along edges 26 and 27 from finger portion 12 to a rounded tip 28. Edge 26 defines an angle E with rim 19 of thirty to forty degrees. Edge 27 defines an angle F with rim 20 of twenty to thirty degrees. Edges 26 and 27 define an angle G of about sixty degrees.

The picking portion 11, as shown in FIG. 2, is defined on tapered surfaces 29 and 30 to give increased flexibility to the picking portion 11 and permit the picking portion to slide off a string rather than to have to stroke through a string. As shown, the surfaces 29 and 30 have a slight concavity. The surfaces 29 and 30 taper down to a very thin and flexible end portion.

Figure 7:
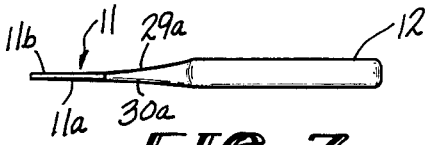
FIG. 7 is a side view similar to FIG. 2, but showing an alternate configuration of a pick embodying the invention.

An alternate form of a pick embodying the invention is shown in FIG. 7 in side elevation. Here, the pick portion 11 initially tapers from the finger portion 12 to a point 11*a*, and then extends into a narrow, very flexible portion 11*b*, defined by two parallel surfaces. The picking portion 11*b* is sufficiently thin to be very flexible, on the order of 0.010 inch, so that it may slide off of a string rather than have to be stroked through a string. In the embodiment of FIGS. 1–4, the surfaces 29 and 30 taper to a thickness of 0.010 inch.

The initial taper from the finger gripping portion initiates the sliding of the pick to increase picking speed and the pick rapidly slides off at the very thin and flexible end portion. By way of example only, the pick may have a width of 0.84 inch and a length of 1.14 inches. As shown in FIG. 1, the finger portion, at the widest point of recess 13 is 0.65 inch. Recess 16 at its widest point is 0.5 inch and its length as measured from a point intersected by imaginary extensions of edges 17 and 24 is 0.625 inch. The thickness of the pick at rims 18 and 20 is 0.125 inch.

The above described picks provide very positive gripping by a musician and permit very rapid transfer from one string to the next or to be returned to the same string.

The picks are made of a molded plastic material such as that identified by the trademark Delrin. The picking portion may be sanded or otherwise altered or shaped by a musician to customize it to his playing style.

The pick, as shown, is formed for a right handed musician. A pick embodying the invention may be formed as a mirror image to that shown for a left handed musician.

It may thus be seen that the objects of the invention set forth, as well as those made apparent from the foregoing description, are efficiently attained. While preferred embodiments of the invention have been set forth for purposes of disclosure, however, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A musicians' pick for a stringed instrument comprising a member consisting of a gripping portion and a picking portion, said picking portion being of generally triangular shape extending from said gripping portion and tapering to a picking end, said gripping portion having opposed surfaces and on one surface thereof having a generally rectangularly shaped depression for a thumb bounded by rims on three sides and the picking portion on the fourth side, one of said rims being substantially perpendicular to the length of a gripping thumb at the outer end of the gripping thumb, an oppositely disposed rim bounding said thumb depression inwardly of the outer end of a thumb from said one rim, said gripping portion on the opposite surface thereof having a generally linearly directed depression and having a nominal center line at a substantial transverse angle to the length of said thumb depression but less than ninety degrees.

2. The pick of claim 1 where at least one of said depressions are textured to enhance finger gripping.

3. The pick of claim 1 where said picking portion has opposed surfaces tapering from said gripping portion to said picking end.

4. The pick of claim 3 where said opposed surfaces have a concavity.

5. The pick of claim 1 where said picking portion has opposed surfaces which initially taper from said gripping portion to said picking end followed by a portion having essentially parallel surfaces and being of a thin width to enhance flexibility.

6. The pick of claim 1 where said second recess runs out at the finger gripping end of said pick.

7. The pick of claim 1 where said thumb recess is generally trapezoidal with a wider portion toward the end to be gripped by the outer end of the thumb.

8. A musicians' pick for a stringed instrument comprising a member consisting of a gripping portion and a picking portion, said picking portion being generally triangular in shape with side edges tapering from said gripping portion to a rounded end, said gripping portion being relatively thick and generally rectangular, said picking portion having opposed surfaces tapering from said finger gripping portion to said end, said end being relatively thin and flexible, said gripping portion having a depression for a thumb on one side thereof and a depression for a finger on the other side thereof, said thumb gripping portion extending substantially perpendicular of the length of said pick, said finger griping portion being generally linearly directed and having a nominal center line at a substantially transverse angle to the length of said thumb depression but less than ninety degrees.

9. The pick of claim 8 where said opposed surfaces are slightly concave.

10. The pick of claim 8 where said opposed surfaces are first tapered from said finger gripping portion and then extend into parallel surfaces prior to said end.

* * * * *